US006189818B1

(12) United States Patent
Kunz et al.

(10) Patent No.: US 6,189,818 B1
(45) Date of Patent: Feb. 20, 2001

(54) PROCESS FOR STABILIZING AND REUSING LADLE SLAG

(75) Inventors: Keith Kunz, Canfield, OH (US); Craig Pinhey, Rothesay; Jim Manning, Roseneath, both of (CA)

(73) Assignee: BPI, Inc., Pittsburgh, PA (US)

( * ) Notice: Under 35 U.S.C. 154(b), the term of this patent shall be extended for 0 days.

(21) Appl. No.: 09/352,946

(22) Filed: Jul. 14, 1999

(51) Int. Cl.[7] ..... B02C 11/08
(52) U.S. Cl. ..... 241/23
(58) Field of Search ..... 241/23, 20, 24

(56) References Cited

U.S. PATENT DOCUMENTS 4,046,323 * 9/1977 McKerrow et al. ..... 241/23
4,722,483 * 2/1988 Saville et al. ..... 241/23
5,067,659 * 11/1991 Heeren et al. ..... 241/19

* cited by examiner

*Primary Examiner*—Rodney A. Butler
(74) *Attorney, Agent, or Firm*—Bacon & Thomas, PLLC

(57) ABSTRACT

Molten ladle metallurgy furnace (LMF) slag is chilled on a chill plate comprising a number of steel slabs disposed side by side. The slag is poured onto the chill plate and allowed to solidify without the application of any water. Solid slag is removed from the chill plate by mechanical means and is eventually reused to make synthetic slag after further cooling, crushing and screening.

6 Claims, 2 Drawing Sheets

PROCESS FOR STABILIZING AND REUSING LADLE SLAG

FIELD OF THE INVENTION

This invention relates to the cooling of ladle slag so that it may be recycled into synthetic slag.

BACKGROUND OF THE INVENTION

Ladle slag or LMF slag has been recovered from the steel industry and reused as a slag conditioner for some period of time. Typically, in steel mills, the process for recovering ladle slag is as follows: the ladle slag is created in an LMF or ladle metallurgy furnace by scraping off old furnace slag, and adding fresh slag components to build a cleaner synthetic slag. In some shops, the old slag is treated with aluminum or other deoxidizers to create the same effect. The ladle slag functions to act as a refining aid for the steel in the ladle. Once this refining process is complete, the ladle is moved to a continuous caster. The ladle, at this stage, is opened from the bottom and the steel is drained from the ladle into a tundish and into a continuous caster. As the steel exits from the bottom of the ladle into the tundish, the ladle slag floats on top of the steel in the ladle. The ladle will reach a point when it is nearly empty and some slag may start showing up in the steel. At this point, or some time before this point, the slag gate is closed to shut off the flow of steel into the tundish. The ladle is then removed and the spent ladle slag, along with any remaining steel, is dumped into a slag pot, where it cools. This process is repeated again and again, with steel and slag being layered on top of one another into slag pots. Typically, a slag pot will hold from 3 to 5 taps of spent ladle slag and steel.

Normally, these slag pots are allowed to cool and are tipped over and quenched with water. The reason this product is generally quenched with water is that many spent ladle slags are unstable and exhibit "falling slag" characteristics. The characteristic of a falling slag is that the slag undergoes a phase change at some stage in the cooling process and turns from a solid into a powder. The effect of this is that some portion of the ladle slag falls to a very fine dry powdery dust which becomes an environmental nuisance, and creates difficulty in the rehandling and reuse of ladle slag handled in this conventional manner. For this reason, the slag pots are almost always quenched with water such that any falling slag produced will be wet and will not create an environmental (dusting) problem. Once the slag pot content is quenched and cooled, it is then crushed, the metal is removed for reuse and what is left is typically the spent ladle slag. Prior art in the reuse and reclamation of this ladle slag requires that the slag be crushed and dried and screened for reuse. Because the slag has been soaked with water, it hydrates, creating water of hydration in the slag. Ladle slag that is recovered by this technique is difficult to reuse for three reasons:

1. the slag is hydrated through its contact with moisture and contains undesirable amounts of crystalline moisture and free moisture;
2. the slag contains more fine particles than is desired due to the falling nature of the slag which creates powder;
3. the quenching produces a very wet product which requires energy and cost to dry the free moisture from the product.

An object of the invention is to provide a method of recovering ladle slag in which the above-referenced problems are at least partially addressed.

SUMMARY OF THE INVENTION

In accordance with the invention, ladle slag is cooled relatively quickly so that it solidifies by pouring the ladle slag directly onto a substantially planar chill plate. The chill plate has a sufficient surface area and thermal mass to provide the residence time required to solidify the slag without the application of any cooling water onto the slag at any stage before it is returned for reuse as a component of a synthetic slag.

BRIEF DESCRIPTION OF THE DRAWINGS

In order that the invention may be better understood, a preferred embodiment is described below with reference to the accompanying drawings, in which.

DESCRIPTION OF PREFERRED EMBODIMENT

In a continuous casting process, a ladle containing molten steel and ladle slag typically fills a 315 MT capacity ladle that is moved by crane from a ladle metallurgy furnace (LMF) station to the caster. The steel from the ladle is drained from a slide gate valve in the bottom of the ladle into a tundish until most of the steel is gone. At this time, the steel flow from the ladle is cut off, leaving about 3–4 tons of molten ladle slag and from ½–2 tons of molten steel in the bottom of the ladle.

Figure 1:
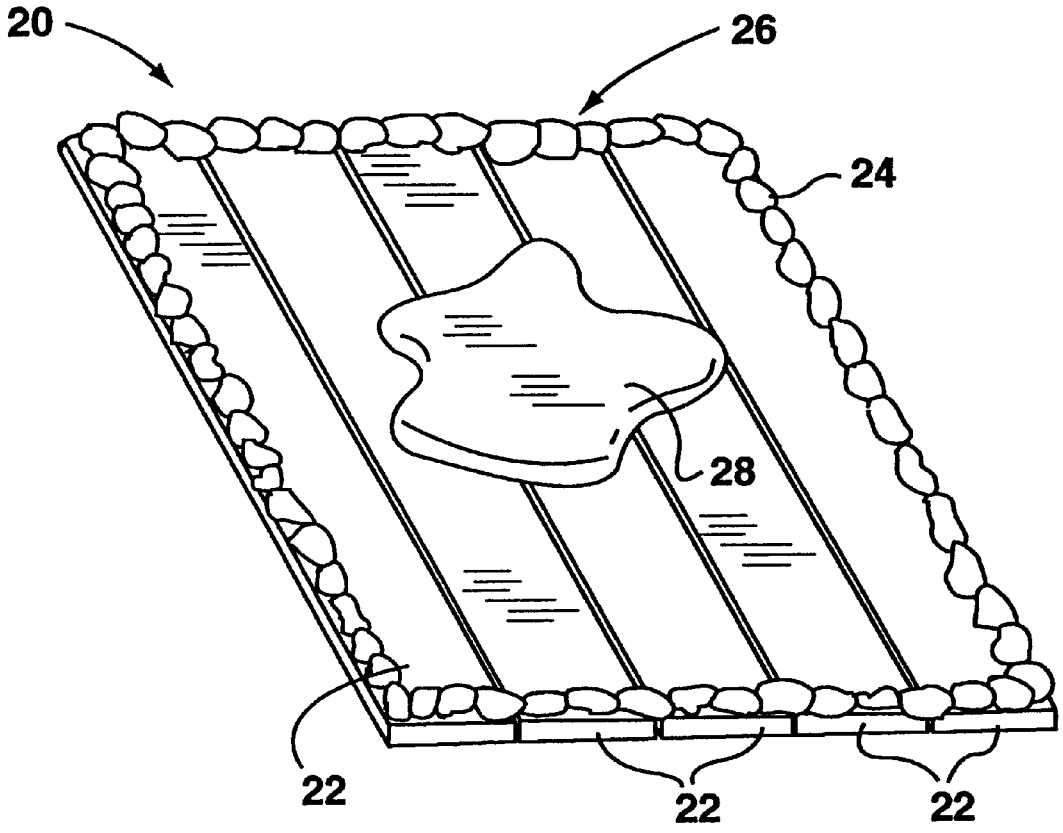
FIG. 1 is a schematic perspective view of a chill plate for use in a method according to the invention.
Figure 2:
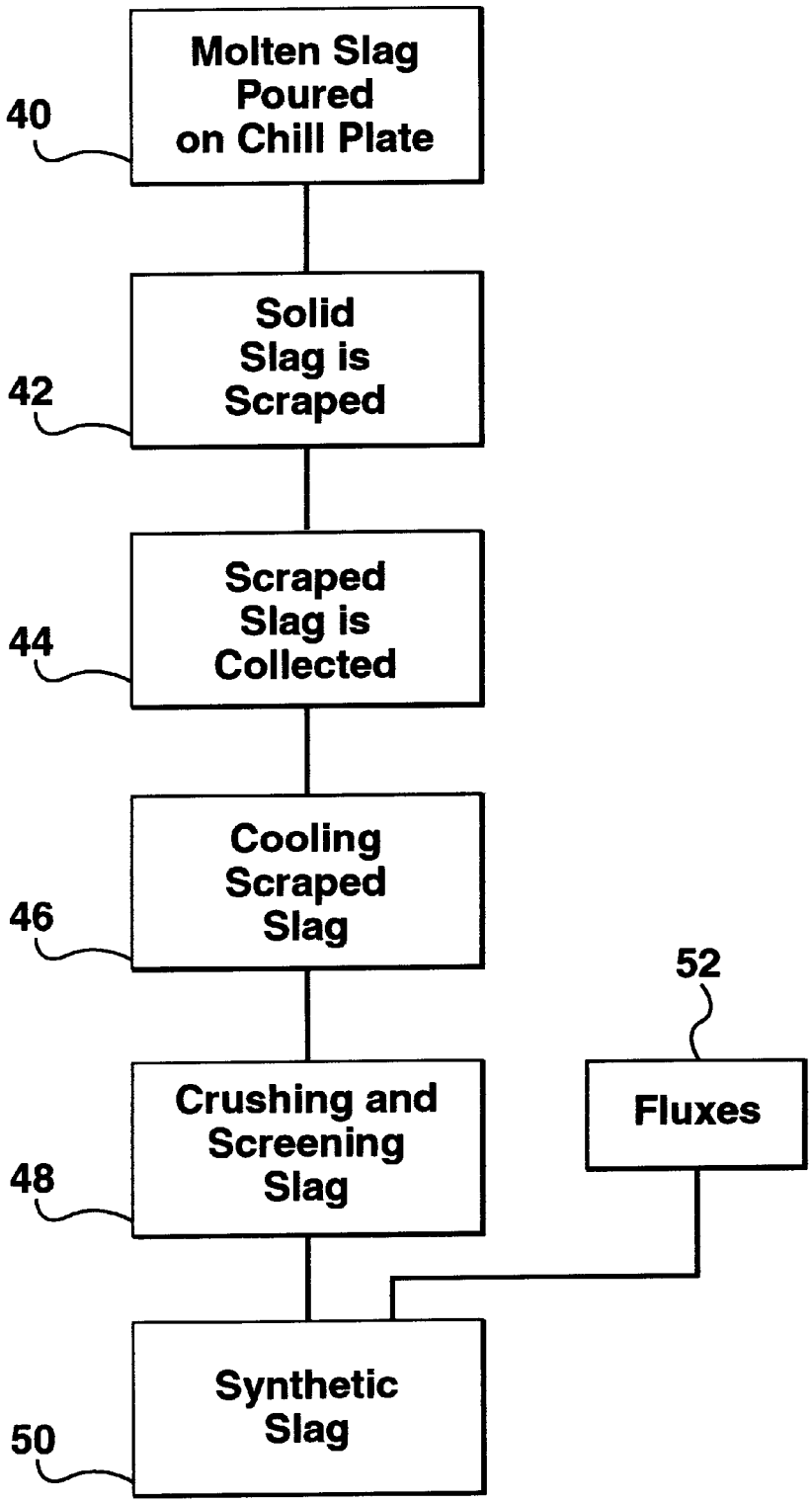
FIG. 2 is a flow chart outlining the steps of a method according to the invention.

The ladle is then lifted by crane and is moved into position to pour onto a chill plate, generally designated in FIG. 1 by reference numeral 20 for quick cooling. This corresponds to step 40 in FIG. 2. The chill plate 20 in this case comprises five steel slabs 22 sized 3.5 ft×16 ft×5 inches thick disposed side by side in abutting relationship to form a substantially planar steel floor with dimensions 17.5 ft×16 ft×5 inches thick. Around the sides of this 17.5 ft×16 ft floor, crushed dry ladle slag 24 is heaped in a row about 12 inches high to build a dam 26 to hold molten slag 28 from running over the perimetric edge of the chill plate 20. The ladle is positioned to pour onto the center of the chill plate 20. The ladle is tilted and molten slag 28 is poured slowly from the ladle onto the chill plate 20. Since slag is lower in density than steel, it floats on top of the steel and pours out of the ladle first. This pouring is continued until steel starts to pour from the ladle. The arrival of steel during the pour is determined visually by noting a color difference between the molten metal and slag and by watching for "sparking" that occurs as molten steel is entrained in the ambient air. Pouring is stopped when steel is detected by righting the ladle.

As the molten slag hits the chill plate 20, it flows to form a molten puddle about 1–5 inches thick, depending on the viscosity of the slag and the levelness of the chill plate 20. The molten slag 28 is allowed to cool for 10–30 minutes until it solidifies. Once in a solid form, the ladle slag is scraped away from the slabs by mechanical means. This corresponds to step 42 in FIG. 2. One method of scraping is to use a small front-end loader and to tilt the lower edge of the loader bucket against the chill plate 20. By driving the loader forward, the lower edge of the bucket breaks up the slag which is forced into the loader bucket as the loader moves forward. One disadvantage of using a loader is that the loader needs eventually to drive up on the chill plate 20, which becomes hot with repeated use. This can lead to tire damage on the hot steel slabs 22 if the loader is equipped with rubber tires.

An alternate and preferred technique is to scrape the slag away from the chill plate 20 with a hydraulic excavator equipped with a scraping bucket. In this embodiment, the excavator is parked off the chill plate 20 and the bucket is extended to the end of the plate and is lowered and pulled back towards the excavator, scraping the slag into the bucket and dragging it back towards the excavator.

Scraping is done parallel to the steel slabs. Once an area of the floor has been scraped clean, the excavator is moved and the process is repeated until the whole chill plate 20 is clean. On an average pour, about 2 tons of solidified slag ends up on the chill plate 20. The amount of slag poured onto the chill plate 20 is variable between ½ and 3 tons and is influenced by the amount of molten steel left in the ladle. Removal of the slag from the chill plates by mechanical means usually takes about 10–20 minutes.

Sometimes steel from the ladle also pours onto the chill plates and solidifies in a solid sheet. This steel is removed from the plates by the same mechanical means that is used to remove the slag. The steel is typically easy to separate as it tends to harden into one or two large thin pieces. The metal is put off in a separate collection for remelting into steel.

The steel slabs 22 can vary in size depending upon the amount of ladle slag that is being chilled. It is necessary that the steel slab have a thickness of at least 2" to allow for significant thermal mass to effect cooling with repeated applications. As these slabs 22 are continually heated, they tend to warp as the top surface expands more than the lower surface, causing the slabs to bow over time, making removal of slag more difficult as the surface is no longer flat. The thinner the slabs 22, the more they are inclined to warp. For this reason, it is preferred that the slabs 22 be thicker, preferably four to twelve inches thick. As the slabs 22 bow, they can be straightened by turning them over, whereby subsequent use will cause them to straighten and then bow in the opposite direction.

Once the slag has been scraped from the plate, it is collected in solid form. This corresponds to step 44 in FIG. 2. Later, after cooling to room temperature (step 46), this slag is crushed and sized (step 48) and is ready for reuse and recycling into synthetic slag compositions 50, where it may be mixed with fluxes 52.

The advantage of the invention over the old practice is the following:

1. the quick cooling of the slag results in increased stability, thus eliminating much of the falling slag characteristics;
2. since the slag has not been in contact with water, it does not need to be dried, and it carries no crystalline water, thus being much more desirable for reuse in steelmaking applications;
3. because the slag has been quenched and quick-cooled, it has different physical properties and, when crushed, creates a much more stable aggregate, allowing for a product with more desirable sizing.

It will be apparent to those skilled in the art that several variations may be made to the above-described embodiment of the invention within the scope of the appended claims. While a chill plate comprising a number of steel slabs is preferred because such slabs are readily available and inexpensive, a chill plate may comprise any suitable thermal mass and could, for example, comprise hollow, water-cooled metal jackets or slabs made of graphite.

The chill plate could also be fabricated with a peripheral lip to contain slag when it is molten, instead of using crushed solid slag to create a barrier.

We claim:

1. Method of recovering ladle slag for reuse in a synthetic slag, in which molten ladle slag is discharged onto a substantially planar chill plate, the chill plate having a thermal mass and conductivity which define a heat sink for cooling and solidifying said molten ladle slag into a solid slag without any application of water;

scraping said solid slag from the chill plate to mechanically dislodge the solid slag;

collecting dislodged solid slag;

further cooling dislodged solid slag to ambient temperature without any application of water; and crushing and screening said solid slag cooled to ambient temperature.

2. Method according to claim 1 in which said chill plate comprises at least one slab of steel.

3. Method according to claim 1 in which solid slag is disposed on a perimetric edge of said chill plate to define a barrier for containing said molten ladle slag on the chill plate.

4. Method according to claim 2 in which said chill plate comprises a number of slabs of steel disposed side by side in abutting relationship.

5. Method according to claim 2 in which each slab of steel has a thickness of at least two inches.

6. Method according to claim 5 in which each slab of steel has a thickness of four to twelve inches.

* * * * *